US007487603B2

(12) United States Patent
Davis et al.

(10) Patent No.: US 7,487,603 B2
(45) Date of Patent: Feb. 10, 2009

(54) ARTICLE OF FOOTWEAR WITH FASTENING SYSTEM

(75) Inventors: Sally J. Davis, Aloha, OR (US); Michael R. Friton, Portland, OR (US); Nuria Hansen, Portland, OR (US); Sarah M. McCully-Posner, Portland, OR (US)

(73) Assignee: Nike, Inc., Beaverton, OR (US)

( * ) Notice: Subject to any disclaimer, the term of this patent is extended or adjusted under 35 U.S.C. 154(b) by 290 days.

(21) Appl. No.: 11/422,262

(22) Filed: Jun. 5, 2006

(65) Prior Publication Data

US 2007/0277398 A1 Dec. 6, 2007

(51) Int. Cl.
*A43C 11/00* (2006.01)

(52) U.S. Cl. ..... 36/50.1

(58) Field of Classification Search ..... 36/50.1
See application file for complete search history.

(56) References Cited

U.S. PATENT DOCUMENTS

| | | | | |
|---|---|---|---|---|
| 177,396 | A * | 5/1876 | Harris | 36/50.1 |
| D57,288 | S | 3/1921 | Wagner | |
| 1,497,568 | A * | 6/1924 | Kelley | 36/51 |
| 2,143,556 | A | 1/1939 | Hodaly | |
| D274,291 | S | 6/1984 | Migdow | |
| D343,277 | S | 1/1994 | Richard et al. | |
| 5,345,697 | A | 9/1994 | Quellais | |
| D352,784 | S * | 11/1994 | Cohen et al. | D24/192 |
| D365,438 | S | 12/1995 | Orzeck | |
| 5,537,763 | A | 7/1996 | Donnadieu et al. | |
| 5,659,982 | A | 8/1997 | Muraoka et al. | |
| D387,893 | S | 12/1997 | Bathum | |
| 5,755,044 | A | 5/1998 | Veylupek | |
| D438,972 | S | 3/2001 | Darby | |
| 6,270,468 | B1 | 8/2001 | Townsend et al. | |
| 6,282,818 | B1 * | 9/2001 | Lu | 36/110 |
| D473,702 | S | 4/2003 | Burg et al. | |
| 6,757,991 | B2 | 7/2004 | Sussmann | |
| 6,941,683 | B2 | 9/2005 | Freed | |
| D513,361 | S | 1/2006 | Teriatnikov | |
| 2005/0060912 | A1 | 3/2005 | Holzer et al. | |

* cited by examiner

*Primary Examiner*—Ted Kavanaugh
(74) *Attorney, Agent, or Firm*—Plumsea Law Group, LLC

(57) ABSTRACT

An article of footwear including a fastening system. The fastening system can include a pull tab and one or more flaps that cooperate to provide a more secure and snug fit, eliminates the need for conventional laces and a conventional tongue, and is easy to operate, especially for children or people with disabilities.

20 Claims, 4 Drawing Sheets

ARTICLE OF FOOTWEAR WITH FASTENING SYSTEM

BACKGROUND OF THE INVENTION

1. Field of the Invention

The present invention relates generally to an article of footwear, and in particular to an article of footwear with a novel fastening system.

2. Description of Related Art

Various lacing systems for footwear have been proposed. In some cases, these lacing systems include features where the free ends of the laces are gathered together. Freed (U.S. Pat. No. 6,941,683) discloses a lacing system where four lace segments 1, 2, 3 and 4 are attached to a strap or movable fastener 160. Strap 160 is capable of tightening the laces with a single pull. See column 7, line 1 to line 21.

Donnadieu et al. (U.S. Pat. No. 5,537,763) discloses a system for returning to a pre-set tension on the laces of a boot. Donnadieu discloses a tensioning and latching means 8 that includes a link 7, that is attached to free ends 7a and 7b. Link 7 is attached to base 23 via connection means 14. By attaching link 7 to base 23 using connection means 14, the wearer is able to return the lacing system to a pre-set tension. Quellais (U.S. Pat. No. 5,345,697) teaches a tensioning system similar to the Donnadieu system.

Sussmann (U.S. Pat. No. 6,757,991) discloses a sports shoe with a tensioning flap or shield. Tensioning flap 8 includes a row of lacing eyelets that correspond or are opposite to a row of eyelets disposed on the upper. In some embodiments, Sussmann teaches the use of a single pulling site for tensioning flap 8.

Holzer et al. (U.S. patent application publication No. 2005/0060912) discloses a lacing system for a shoe that includes two lacing regions. A first lower region 13 where lace loops are laterally aligned and disposed across from one another, and a second region 14 where lace loops are generally vertically off-set. Holzer also teaches the use of a fixing means 18 attached to a tensioning means cord 30.

While various fastening systems have been proposed, there is still a need for a fastening system that is simple, provides a more secure and snug fit, eliminates the need for conventional laces and a conventional tongue, and is easy to operate, especially for children or people with disabilities.

SUMMARY OF THE INVENTION

The invention is directed to an article of footwear with a fastening system. In one aspect, the article of footwear includes an upper and an outsole; the upper including a centerline dividing a first side of the upper with a second side of the upper; the upper including a fastening system; the fastening system including a first flap extending over the centerline and a second flap extending over the centerline; the first flap having a first flap fastener disposed on an underside of the first flap; the second flap having a second flap fastener; where the first flap fastener engages the second flap fastener when the first flap and the second flap are in a closed position.

In another aspect, the first flap fastener is a releasable fastener.

In another aspect, the second flap fastener is a releasable fastener.

In another aspect, a first strap has a first end attached to the first side of the upper and extends to the second side of the upper.

In another aspect, a first end of a second strap is attached to the second side of the upper, the second strap having a central portion that extends to the first side of the upper, and wherein the central portion of the second strap is associated with the first side of the upper.

In another aspect, the second end of the second strap is attached to a pull tab.

In another aspect, the first strap has a second end that is also attached to the pull tab.

In another aspect, the pull tab includes a pull tab fastener disposed on the pull tab, and wherein the pull tab fastener engages the second flap fastener.

In another aspect, the invention provides an article of footwear comprising: an upper and an outsole; the upper including a centerline dividing a first side of the upper with a second side of the upper; the upper including a fastening system; the fastening system including a first strap, the first strap including a first end attached to the first side of the upper, and a second end attached to a pull tab; the fastening system also including a second strap having a first end attached to the second side of the upper and a second end attached to the pull tab; the pull tab including a pull tab fastener; wherein the pull tab fastener engages a second flap fastener disposed on a second flap when the article of footwear is in a closed position; and wherein the second flap extends across the centerline when the article of footwear is in the closed position.

In another aspect, the pull tab can be moved rearward and upwards when tightening and then attached to the second flap.

In another aspect, the second flap fastener extends rearward, and wherein the pull tab can be attached to the second flap in various locations.

In another aspect, the second flap fastener extends rearward, and wherein the pull tab can be attached to the second flap in various locations.

In another aspect, the second flap fastener extends along a collar disposed proximate to an opening of the article of footwear.

In another aspect, the first strap is attached to the first flap.

In another aspect, the invention provides an article of footwear comprising: an upper and an outsole; the upper including a centerline dividing a first side of the upper with a second side of the upper; the upper including a fastening system; the fastening system including a first strap, the first strap including a first end attached to the first side of the upper, and a second end attached to a pull tab; the fastening system also including a second strap having a first end attached to the second side of the upper and a second end attached to the pull tab; and the first strap having an intermediate portion attached to the first flap.

In another aspect, the intermediate portion of first strap is attached to the first flap by a stitch.

In another aspect, the first flap extends across the centerline when the article of footwear is in a closed position.

In another aspect, the fastening system includes a second flap disposed under the first flap when the article of footwear is in a closed position.

In another aspect, the second flap extends across the centerline when the article of footwear is in the closed position.

In another aspect, the second flap extends across the centerline when the article of footwear is in the closed position.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
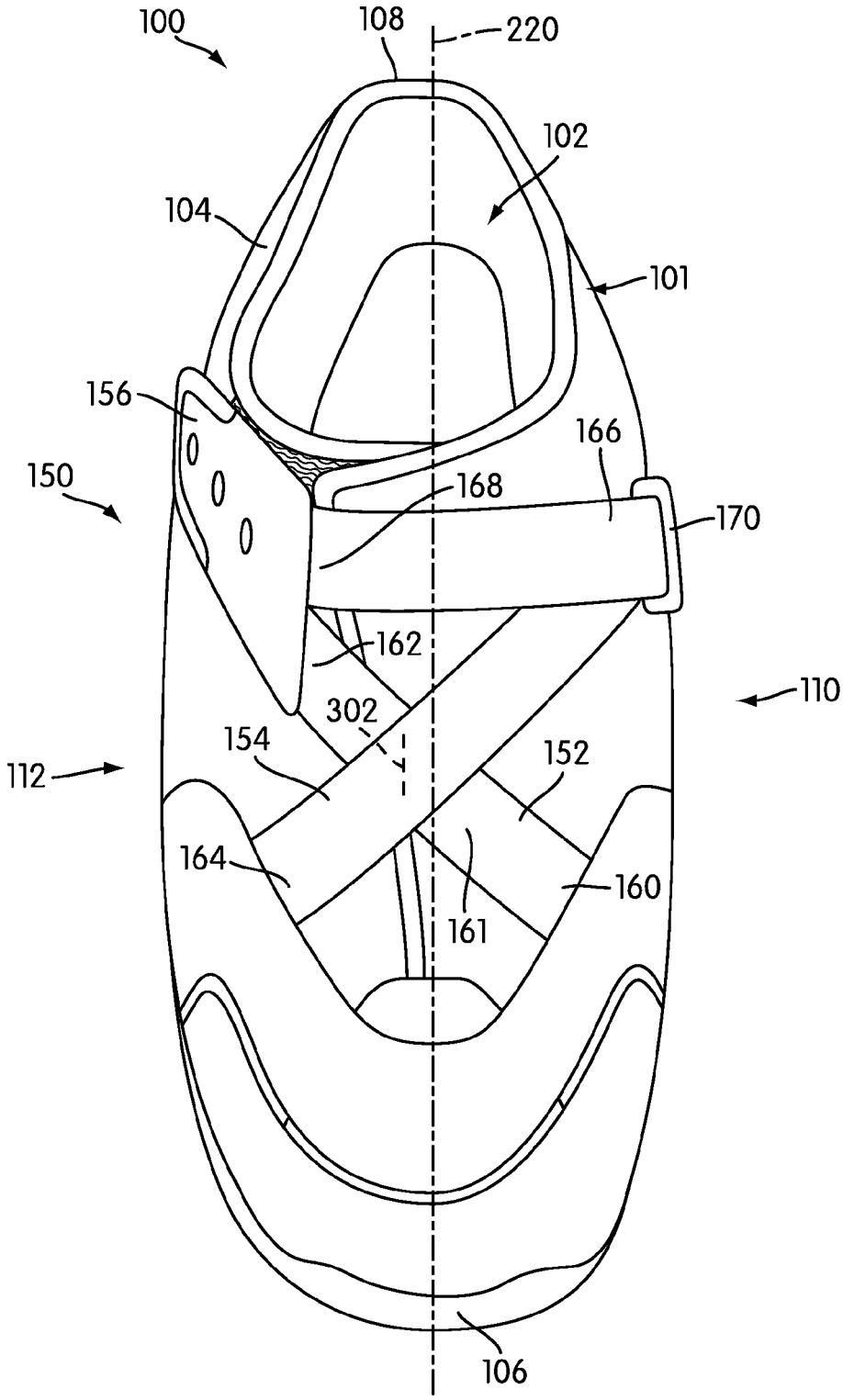
FIG. 1 is a top view of a preferred embodiment of an article of footwear in a closed position.

An article of footwear intended FIG. 1 is a preferred embodiment of an article of footwear. Article of footwear 100 includes an upper 101. Upper 101 is designed to receive the foot of wearer, and opening 102 is used to slide the foot inside upper 101. Immediately surrounding opening 102 is collar 104. Collar 104 preferably extends around the outer periphery of opening 102 and forms the upper portion of upper 101 near opening 102.

Upper 101 includes a forward portion 106 and a rearward portion 108. Forward portion 106 is disposed near the wearer's toe, and rearward portion 108 is disposed near the wearer's heel. Upper 101 also includes first side 110 and second side 112. As shown in FIG. 1, second side 112 is preferably disposed on the opposite side of upper 101 as first side 110.

In a preferred embodiment, upper 101 includes a fastening system 150. Fastening system 150 is preferably designed to allow upper 101 to be opened and closed easily. Fastening system 150 allows the wearer to quickly and easily open upper 101 to insert or remove the wearer's foot. Fastening system 150 also provides a very simple and convenient closing system.

Preferably, fastening system 150 includes first strap 152 and second strap 154. In some embodiments, straps 152 and 154 may be elastic. Elastic straps may provide additional tension to upper 101 when the upper 101 is in the closed position, and may help to hold the wearer's foot more securely inside the article of footwear 100. However, other embodiments may include flexible, but inelastic straps.

First strap 152 includes a first end 160 and second end 162. In the embodiment shown in FIG. 1, first end 160 of first strap 152 is disposed on a forward portion of first side 110. Second end 162 of first strap 152 is disposed on second side 112 of upper 110. Second end 162 of first strap 152 is also disposed rearward of first end 160 of first strap 152.

Preferably, fastening system 150 includes second strap 154. Preferably, second strap 154 includes a first end 164 and a second end 166. Preferably, first end 164 of second strap 154 is disposed on a second side 112 of upper 101. In other words, first end 164 of second strap 154 is disposed on the opposite side of upper 101 as the first end 160 of the first strap 152.

Preferably, the central portion 166 of second strap extends rearward and across upper 101. Central portion 166 of second strap 154 is preferably threaded through ring 170. In some embodiments, ring 170 can be an eyelet. Second strap 154 then continues and extends across upper 110 where second end 168 of second strap 154 terminates in pull tab 156.

Preferably, second end 168 of second strap 154 is disposed on the second side 112 of upper 101 when fastening system 150 is closed. In a preferred embodiment, second end 168 of second strap 154 is attached to pull tab 156. The exemplary embodiment shown in FIG. 1, second end 162 of first strap 152 is also connected to pull tab 156. In other words, pull tab 156 is attached to the second ends 162 and 168 of both straps 152 and 154.

Different designs may place pull tab 156 on different sides of the wearer's foot. For example, in some embodiments. pull tab 156 may be disposed on the medial side of the wearer's foot when upper 101 is closed. While in other embodiments, pull tab 156 may be located on the lateral side when upper 101 is closed. In a preferred embodiment, pull tab 156 is located on the lateral side of the wearer's foot.

In operation, the wearer can grasp pull tab 156 and move the tab in a rearward direction. Pull tab 156 can also be moved circumferentially around collar 104 towards second side 112. Pull tab can also be moved vertically upwards towards opening 102. Once pull tab 156 is moved in this manner, pull tab 156 is able to pull the second ends 162 and 168 of both straps 152 and 154 at the same time.

Figure 2:
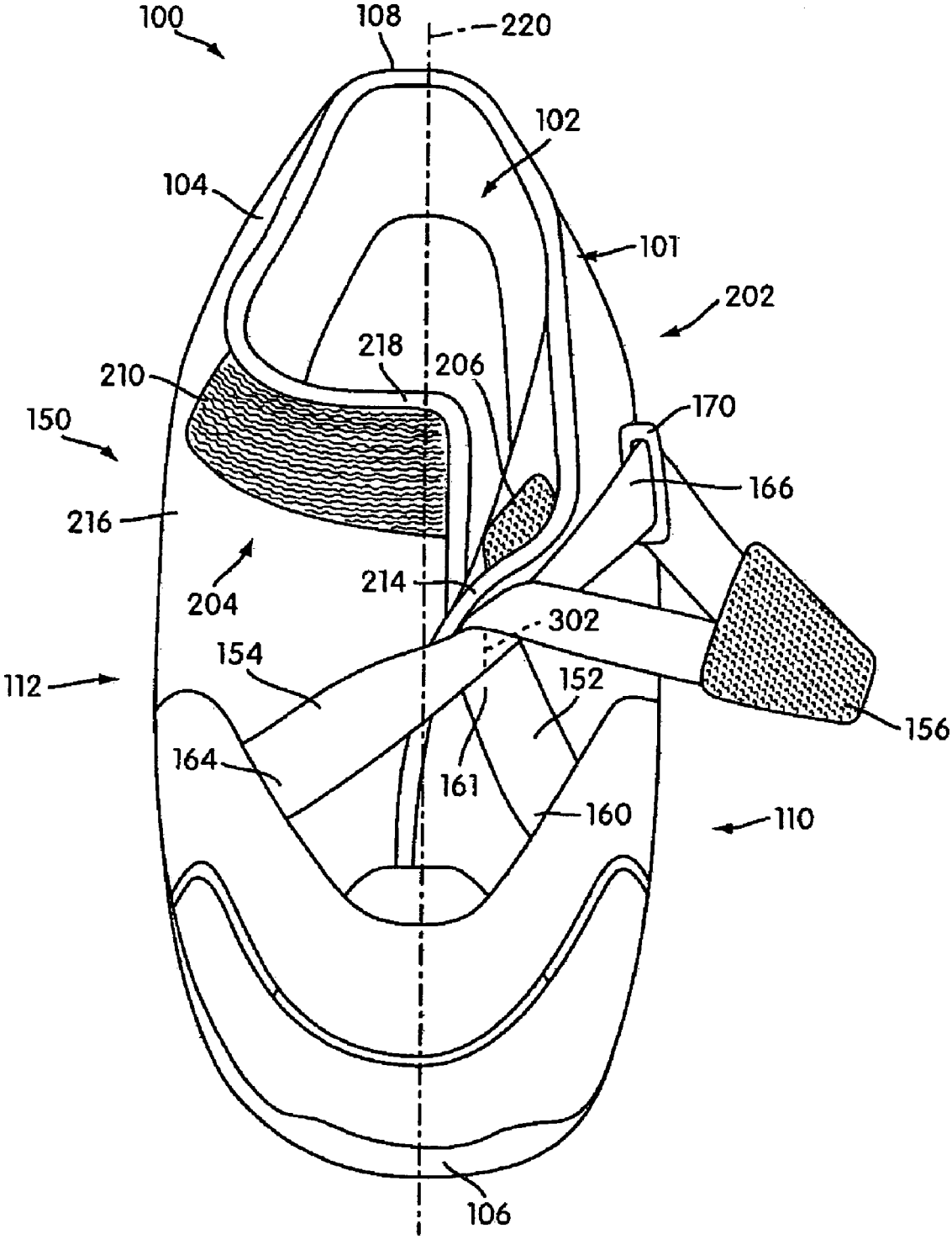
FIG. 2 is a top view of a preferred embodiment of an article of footwear in an open position.
Figure 3:
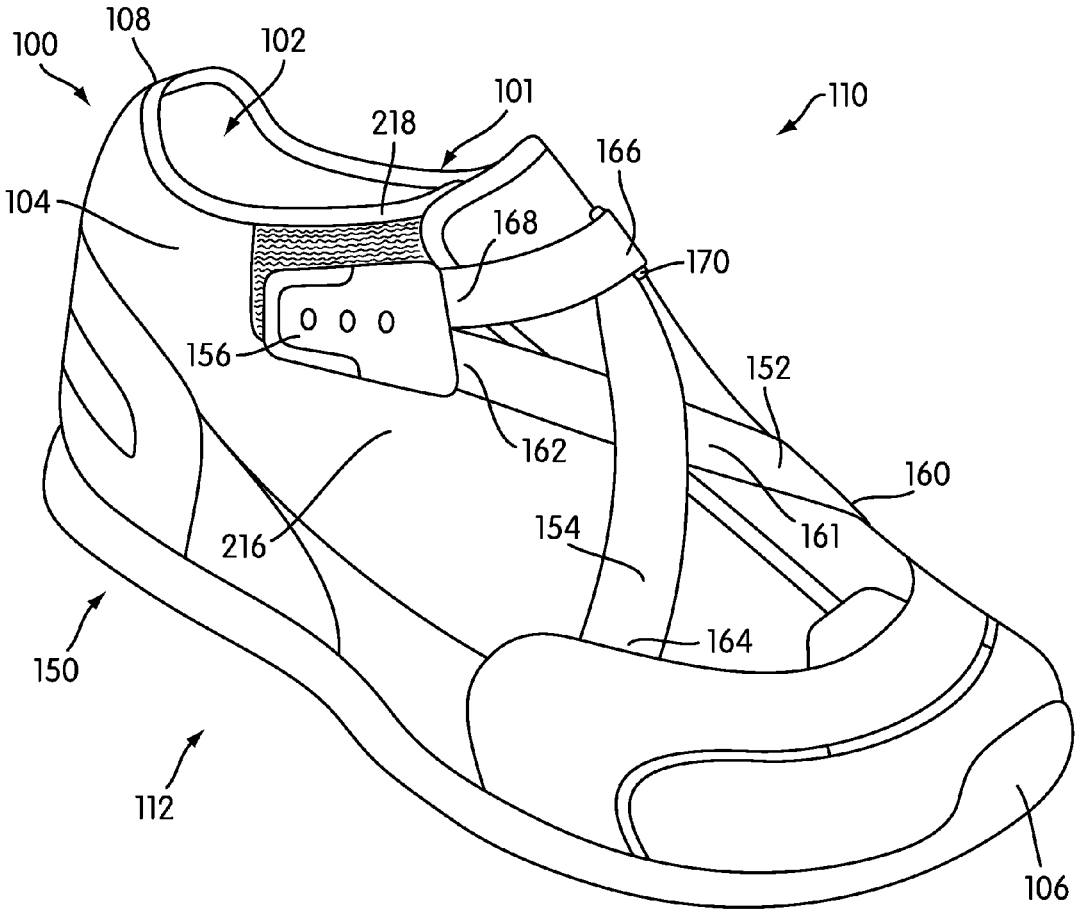
FIG. 3 is an isometric view of a preferred embodiment of an article of footwear in an open position.
Figure 4:
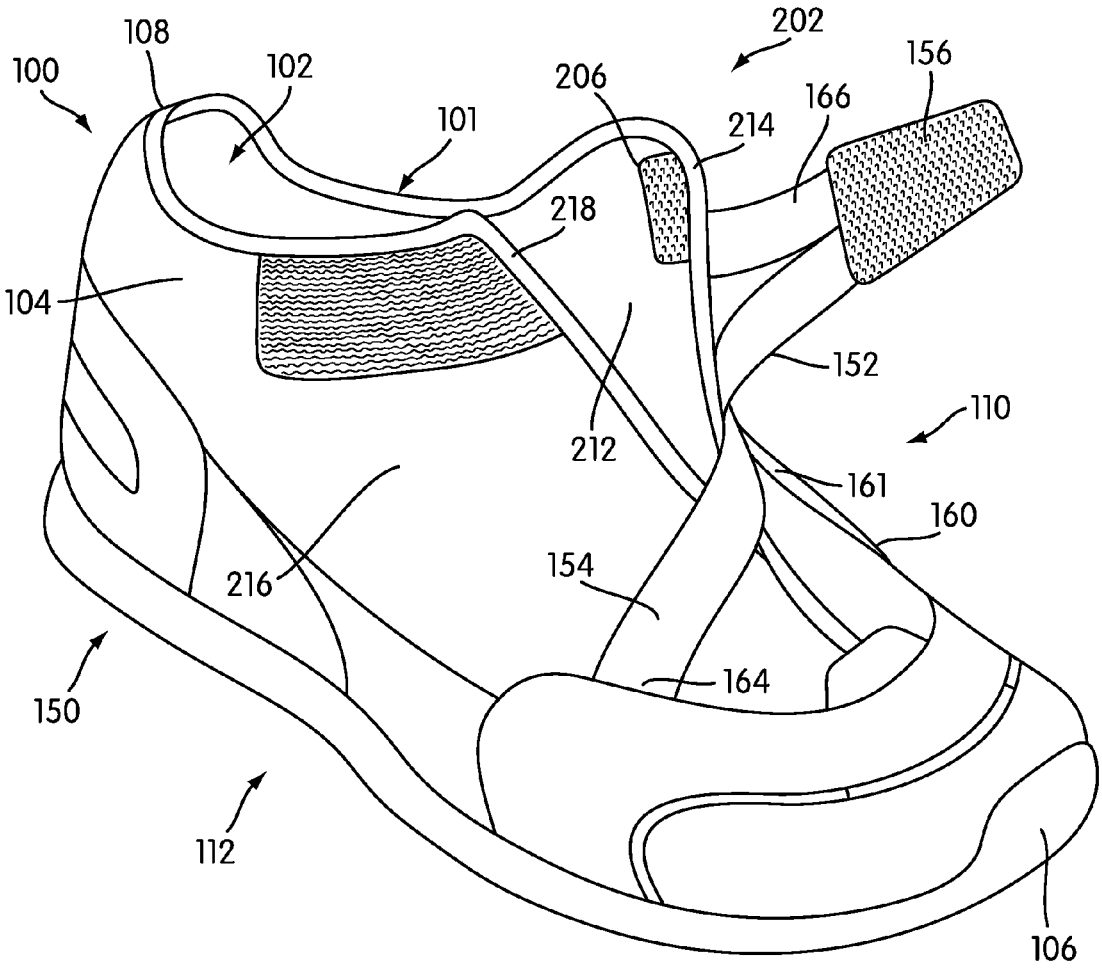
FIG. 4 is an isometric view of a preferred embodiment of an article of footwear in a closed position.

Additional operational and structural details of the invention can be observed in FIG. 2, which is a preferred embodiment of a schematic diagram of upper 101 in an open position. Upper 101 includes a first flap 202 and a second flap 204. First flap 202 is disposed on first side 110, and second flap 204 is disposed on second side 112.

Preferably, first flap 202 includes a first flap base portion 212 and a first flap end portion 214. Similarly, second flap 204 includes a second flap base portion 216 and a second flap end portion 218. In a preferred embodiment, first flap 202 includes a fastener. In the exemplary embodiment shown in FIG. 2, first flap 202 includes a first flap fastener 206 that is disposed on first flap end portion 214. Second flap 204 also preferably includes a fastener. In the embodiment shown in FIG. 2, second flap fastener 210 is disposed on second flap end portion 218 and extends rearward.

In some embodiments, first flap 202 and second flap 204 can be designed to eliminate the need for a conventional tongue. In some cases, this can be done by providing an overlapping arrangement of flaps. In a preferred embodiment, first flap 202 and second flap 204 overlap to provide a generally asymmetrical upper 101.

In the embodiment shown in FIG. 2, first flap end portion 214 extends beyond center line 220 of upper 110 and into second side 112 of upper 101. In some embodiments, portions of second flap 204 can also extend across center line 220. In the preferred embodiment shown in FIG. 2, second flap end portion 218 extends beyond center line 220 and into first side 110. Because the ends of both flaps extend into the opposite of the shoe, first and second flaps 202 and 204 may overlap.

Preferably, fasteners can be used in combination with this overlap feature to provide a secure fastening system 150 for upper 101. Some embodiments include provisions for joining the overlapping flaps. In the embodiment shown in FIG. 2, first flap 202 includes first flap fastener 206 disposed on first flap end portion 214. First flap fastener 206 is preferably designed to engage second flap fastener 210 disposed on second flap 204. Any fastener may be used, however a releasable fastener is preferred.

In an exemplary embodiment, a hook and loop fastener may be used. In the embodiment shown in FIG. 2, first flap end portion 214 includes the hook side of a hook and loop fastener. In the embodiment shown in FIG. 2, second flap fastener 210 includes the loop side of a hook and loop fastener. Using this arrangement, first flap fastener 206 can engage second flap fastener 210 and securely close upper 101.

Some embodiments include provisions that allow pull tab 156 to engage a corresponding fastener on the second side 112 of upper 101. In some embodiments, pull tab 156 engages the same fastener as first flap fastener 206. In a preferred embodiment, second flap fastener 210 is large enough to accommodate both first flap fastener 206 and pull tab 156. In the embodiment shown in FIG. 2, the underside of pull tab 156 preferably includes a fastener compatible with second flap fastener 210. In the exemplary embodiment shown in FIG. 2, pull tab fastener 156 includes the hook side of a hook and loop fastener. Using this arrangement, the first side 110 can be secured to the second side 112 by using multiple fasteners. This can provide a very secure closing system for upper 101.

In operation, the wearer's foot may be placed inside upper 101, and then first flap fastener 206 may be pulled across from first side to second side and secured on second flap fastener 210. After that has been done, the wearer may move pull tab 156 towards rearward portion 108, the wearer may also move pull tab 156 in an upward direction as well, and attach pull tab 156 to second flap fastener 210. It is also possible to move pull tab 156 and simultaneously engage first flap fastener 206 with second flap fastener 210 while pull tab 156 is also being engaged with second flap fastener 210. Using this method, the wearer can close upper 101 with a single motion.

Upper 101 can also be opened in a similar manner. Pull tab 156 may be disengaged from second flap fastener 210, thus separating pull tab 156 from second flap fastener 210. Some embodiments include provisions that assist the pull tab 156 in moving first flap 202. In these embodiments, continuing to move pull tab 156 towards first side 110 will also release first flap fastener 206 from second flap fastener 210.

Preferably, either pull tab 156 or one of the straps 152 or 154 is joined in some way with first flap 202. This joint helps to move first flap 202 when pull tab 156 is moved. In a preferred embodiment, optional stitch 302, shown in FIG. 1, is provided to join first strap 152 with first flap 202. This arrangement assists pull tab 156 in separating first flap fastener 206 from second flap fastener. Preferably, stitch 302 joins an intermediate portion 161 of first strap 152 to first flap 202. Intermediate portion 161 is disposed between first end 160 of first strap 152 and second end 162 of first strap 152. Because intermediate portion 161 is joined to first flap 202, the motion of pull tab 156 causes intermediate portion 161 to also move, resulting in the motion of first flap 202. Thus, upper 101 can be opened with a single motion of pull tab 156 from second side 112 to first side 110.

In some embodiments, pull tab 156 may not be able to disengage first flap fastener 206 with second flap fastener 210. In those embodiments where pull tab 156 is unable to disengage first flap fastener 206 with second flap fastener 210, the wearer may manually disengage first flap fastener 206 with second flap fastener 210.

In those embodiments where pull tab 156 is associated with first flap 202, a joint or fastener may be used to associate one of the straps with first flap 202. In a preferred embodiment, a central portion of first strap 152 is preferably stitched to first flap 202. Referring to FIG. 1, stitch 302 can be observed joining first strap 152 with first flap 202.

The fastening system 150 provides a convenient and easy-to-use system that can be operated with one hand. In some embodiments, fastening system 150 can be used on a children's shoe. This can allow children who may find it difficult or inconvenient to lace shoes with a fastening system that is easier to operate.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear comprising:

an upper and an outsole;

the upper including a fastening system;

the fastening system including a first flap overlapping a second flap;

the first flap having a first flap fastener disposed on an underside of the first flap, wherein the first flap fastener is disposed proximate a throat opening;

the second flap having a second flap fastener disposed on an upper side of the second flap, wherein the second flap fastener extends along a collar disposed proximate the throat opening;

wherein the first flap fastener engages the second flap fastener when the first flap and the second flap are in a closed position;

a pull tab attached to a first strap and a second strap;

a pull tab fastener disposed on the pull tab; and wherein the pull tab fastener also engages the second flap fastener proximate the throat opening when the pull tab is in a closed position.

2. The article of footwear according to claim 1, wherein the first flap fastener is a releasable fastener.

3. The article of footwear according to claim 2, wherein the second flap fastener is a releasable fastener.

4. The article of footwear according to claim 1, wherein the first strap has a first end attached to a first side of the upper and extends to a second side of the upper.

5. The article of footwear according to claim 4, wherein a first end of the second strap is attached to the second side of the upper, the second strap having a central portion that extends to the first side of the upper, and wherein the central portion of the second strap is attached to the first side of the upper.

6. The article of footwear according to claim 5, wherein a second end of the second strap is attached to the pull tab.

7. The article of footwear according to claim 6, wherein the first strap has a second end that is also attached to the pull tab.

8. The article of footwear according to claim 1, wherein the second strap has a central portion that is attached to the first flap; and wherein pulling the pull tab from the closed position separates the pull tab from the second flap fastener and also separates the first flap fastener from the second flap fastener.

9. An article of footwear comprising:

an upper and an outsole;

the upper including a centerline dividing a first side of the upper with a second side of the upper;

the upper including a fastening system;

the fastening system including, a first strap, the first strap including a first end attached to the first side of the upper in a forefoot region of the upper, an intermediate portion slidably attached to the second side of the upper proximate a throat opening, and a second end attached to a pull tab;

the fastening system also including a second strap having a first end attached to the second side of the upper in the forefoot region of the upper and a second end attached to the pull tab;

the pull tab including a pull tab fastener;

wherein the pull tab fastener engages a second flap fastener disposed on a second flap when the article of footwear is in a closed position;

wherein the second flap fastener is disposed proximate a collar disposed proximate an opening of the article of footwear; and wherein the second flap extends across the centerline when the article of footwear is in the closed position to overlap a first flap.

10. The article of footwear according to claim 9, wherein the pull tab can be moved rearward and upwards when tightening and then attached to the second flap.

11. The article of footwear according to claim 9, wherein the second flap fastener extends rearward, and wherein the pull tab can be attached 7to the second flap in various locations.

12. The article of footwear according to claim 9, wherein the second flap fastener extends rearward, and wherein the pull tab can be attached to the second flap in various locations.

13. The article of footwear according to claim 9, wherein the second flap fastener extends along the collar.

14. The article of footwear according to claim 9, wherein the first strap is attached to the first flap.

15. An article of footwear comprising:

an upper and an outsole;

the upper including a centerline dividing a first side of the upper with a second side of the upper;

the upper including a fastening system;

the fastening system including a first strap, the first strap including a first end attached to the first side of the upper in a forefoot region of the upper, and a second end attached to a pull tab;

the fastening system also including a second strap having a first end attached to the second side of the upper in the forefoot region of the upper, and a second end attached to the pull tab;

a ring attached to the upper proximate a throat opening, wherein a second strap intermediate portion is threaded through the ring;

a first strap intermediate portion attached to the first side of the upper; and wherein the pull tab engages with a fastener positioned on the second side of the upper proximate the throat opening when the article of footwear is in a closed position;

wherein pulling the pull tab tightens the upper on a wearer's foot; and wherein the pull tab can be attached to the fastener in various locations.

16. The article of footwear according to claim 15, wherein the first strap intermediate portion is attached to the first side of the upper by a stitch.

17. The article of footwear according to claim 15, wherein the first side of the upper includes a first flap that extends across the centerline when the article of footwear is in the closed position.

18. The article of footwear according to claim 15, wherein the fastening system includes a second flap disposed under the first side of the upper when the article of footwear is in the closed position.

19. The article of footwear according to claim 18, wherein the second flap extends across the centerline when the article of footwear is in the closed position.

20. The article of footwear according to claim 15, wherein the second strap extends across the first strap.

* * * * *